US006058946A

United States Patent [19]

Bellati et al.

[11] Patent Number: 6,058,946

[45] Date of Patent: May 9, 2000

[54] DELIVERY DEVICE

[76] Inventors: Riccardo Paolo Federico Bellati, 16 Via Molino S. Gicvane, 20058 Villasanta, Italy; Robert John Monaghan, 41 Donovan Avenue, Muswell Hill, London N10 2JU, United Kingdom; Martyn Noel Wallwork, 24 Simpson Street, Battersea, London SW11 3HN, United Kingdom; Matthew David Cotterill, 42 St Paul's Close. Ealing Common, London, United Kingdom; Alan Digby Tomlinson, Kaag 23, 3121 Xe Schiedam; Marco Franciscus Van Dijk, Frieslandlaan 22, 3137 GG Vlaardingen, both of Netherlands

[21] Appl. No.: 08/957,667

[22] Filed: Oct. 24, 1997

[30] Foreign Application Priority Data

Oct. 25, 1996 [EP] European Pat. Off. ..... 96307736

[51] Int. Cl.[7] ..... B08B 9/20; B08B 3/00; B01D 11/02

[52] U.S. Cl. ..... 134/25.2; 134/18; 134/93; 68/17 R; 422/264; 422/266

[58] Field of Search ..... 134/93, 25.1, 25.2, 134/18; 68/17 R; 422/264, 266, 277; 222/54

[56] References Cited

U.S. PATENT DOCUMENTS

| | | | |
|---|---|---|---|
| 3,160,319 | 12/1964 | Patzelt et al. . | |
| 3,584,763 | 6/1971 | Donselman | 222/54 |
| 3,674,700 | 7/1972 | Gaiser | 510/298 |
| 3,739,942 | 6/1973 | Mercer et al. | 222/54 |
| 4,219,436 | 8/1980 | Gromer et al. | 510/224 |
| 4,545,917 | 10/1985 | Smith et al. . | |
| 4,549,693 | 10/1985 | Barlics . | |
| 4,899,543 | 2/1990 | Romanelli et al. . | |
| 5,133,487 | 7/1992 | Russi | 222/651 |
| 5,176,297 | 1/1993 | Mooney et al. | 222/325 |
| 5,264,043 | 11/1993 | Milocco | 134/25.2 |

FOREIGN PATENT DOCUMENTS 0 611 159 8/1994 European Pat. Off. .

*Primary Examiner*—Randy Gulakowski
*Assistant Examiner*—Alexander Markoff

[57] ABSTRACT

A delivery device for delivering a dose of washing material, especially a detergent tablet, into the interior of a washing apparatus such as a machine dishwasher. In one preferred form, the device comprises:

a chamber for containing the dose of washing material to be delivered, the chamber including at least one opening for allowing communication between the interior of the chamber and the outside of the device;

closure means for selectively closing or opening the at least one opening in the chamber; and temperature sensitive actuation means constructed and arranged for causing the closure means to move from their closed condition to their open position at a point or stage in the wash cycle of the apparatus at which a predetermined temperature within the interior of the apparatus is reached. The temperature sensitive actuation means preferably comprises a temperature sensitive actuation element, e.g. a bimetallic strip, in combination with a spring which moves the closure means from their closed to their open position when triggered to do so by the actuation element. Alternatively, in other embodiments the temperature sensitive actuation means may comprise simply a memory spring. In the context of an automatic dishwashing machine, triggering of the release of the detergent tablet can be arranged to occur when the temperature inside the machine reaches that indicative of the beginning of a main wash cycle e.g. 35 or 40 to 80° C., following completion of a preceding, cooler, prewash stage.

13 Claims, 7 Drawing Sheets

DELIVERY DEVICE

FIELD OF THE INVENTION

This invention relates to a device for delivering a dose of a washing material, especially but not exclusively a dose of a detergent composition such as in the form of a tablet, into the interior of a washing apparatus, in particular an automatic dishwashing machine. More particularly, the invention relates to such a delivery device which delivers the dose of washing material at a predetermined selected point or stage in the washing cycle.

BACKGROUND OF THE INVENTION AND PRIOR ART

In many known examples of automatic washing apparatuses, particularly dishwashing machines, it is commonly necessary for one or more selected washing materials, e.g. detergent, water softener, rinse aid, to be delivered to the interior of the apparatus for dispersion into the wash liquor at a particular point or stage in the washing cycle which is not at its beginning. With the prevalence of automatic washing machines which conduct the washing cycle without the need or even ability for human intervention during its progress, it has therefore been necessary to find ways of introducing the required washing material(s) in such a way as to optimise their action, minimise waste and preferably deliver them only at the point or stage in the cycle at which they are needed.

One way in which this aim has hitherto been achieved is to incorporate in the machine specially controlled delivery means which enable a dose of the required washing material to be charged into the machine before the cycle commences and retained in a closed compartment until the predetermined point or stage in the cycle is reached, at which time the delivery means are triggered to release the dose of washing material into the interior of the machine at exactly the desired predetermined time in the cycle. The delivery means is triggered to release the dose of washing material by the wash cycle timing control system.

In a practical example of this known delivery system in a machine dishwasher, a compartment is provided on the inside of the door of the machine, into which compartment a dose of usually dishwashing detergent is loaded prior to the wash cycle commencing. The compartment is closed by a retractable door or cover to keep the detergent shielded from water within the machine until such time as delivery of the detergent is triggered by the machine control system at the appropriate predetermined point in the cycle. At that time the compartment door or cover is retracted to allow water to reach and flush out the detergent into the interior of the machine. In a typical dishwasher release of the detergent is triggered at the beginning of the main wash stage, following an initial prewash stage which may last typically for between 2 and perhaps 15 or 20 minutes.

Automatic delivery means controlled by the machine's overall control system, such as described above, do have the advantage of providing the desired degree of control over exactly when in the wash cycle a given dose of washing material is delivered, but this is not without the cost of various drawbacks.

For instance, because the triggering of the delivery means to release the dose of material charged therein is dependent upon the characteristics and duration of any preliminary stages of the wash cycle before the point or stage at which delivery of the washing material is actually required, the overall control system of the machine has to be particularly complex, especially so if the machine is designed to have considerable flexibility in the programming of various selectable combinations or series of individual stages in the overall wash cycle. This makes the complexity and cost of the control system high if the machine is designed to have a wide range of different wash programmes. Also, because the means by which opening of the compartment is triggered is an integral part of what is nowadays a completely automatic electronic control system, any malfunction thereof is correspondingly difficult to diagnose and furthermore difficult and costly to rectify.

A further drawback, following on from the above, is that since the triggered release of the washing material is controlled as an integral feature of the machine's overall control system as constructed and fitted by the machine manufacturer, this can lead to limitations on the versatility of the machine as applied to new detergent and other washing products which may be designed for new styles of use or dispensing or washing regimes. This may represent a hindrance to the development of new commercially viable washing products, particularly since nowadays dishwashing and other washing machines may remain in service for a period of many years.

From the consumer's point of view, dishwashing machines which are cheaper to buy and more straightforward to use are of course more attractive and this may lead to trends away from more technologically advanced designs of machines. This places greater pressures on designers and manufacturers to design operating and washing material release systems which offer the consumer convenience in the use and operating of machines whilst as far as possible not compromising on wash performance. Even with dishwashers for instance which do incorporate controlled release devices for detergent, and particularly in recent years since the launch of detergent in the form of tablets as opposed to the more conventional powders, it has become apparent that consumers increasingly make a habit of not using the machine's controlled release system in the way for which it was designed, but may typically drop the detergent tablet directly into the interior of the machine, e.g. into the cutlery basket, at the time the wash cycle is commenced, even though it will begin with a prewash stage before the main wash stage. Having recognised this trend, certain manufacturers have taken to supplying a simple plastic basket for accommodating the detergent tablet and which is designed to be attached to the cutlery basket or plate rack. Since the detergent is required primarily for the higher temperature main wash stage of the cycle, it is inevitable that during the prewash stage, which can last typically from anything between 2 and 15 to 20 minutes, when used in this way the detergent tablet will at best be partially dissolved during the prewash stage, thereby leaving less detergent available for delivery during the main wash stage. Certain manufacturers have reacted to this by making detergent tablets larger or by formulating the composition so that the tablet dissolves more slowly, but neither of these attempts at solving the problem are without further consequential drawbacks, since of course the first leads to increased cost and wastage, and the second leads to compromised wash performance during the main wash stage of the wash cycle, which is where release of the detergent is primarily needed.

What all these considerations have led to, therefore, is recognition by us of a need for a means of dispensing a dose of washing material into the interior of a dishwashing machine at a selected point or stage in the wash cycle which is independent of the overall machine's control system, yet is reliable in operation, is relatively cheap in design and construction, simple to use and is not at the cost of compromised wash performance. We have addressed the problem in particular in the context of delivering washing material, in particular detergent, into the interior of an automatic dishwashing machine, but the present invention which has resulted is not limited to this and may have utility in the delivery of various washing materials in various types of washing machine.

SUMMARY OF THE INVENTION

Accordingly, in a first aspect the present invention provides a delivery device for delivering a dose of washing material into the interior of a washing apparatus, the device comprising:

a chamber for containing the dose of washing material to be delivered, the chamber being selectively openable or closable for selectively allowing communication between the interior of the chamber and the outside of the device; and temperature sensitive actuation means constructed and arranged for causing the chamber to be opened from a closed condition at a point or stage in the wash cycle of the apparatus at which a predetermined temperature within the interior of the apparatus is reached.

In a first practical form of the delivery device of the invention the chamber includes at least one opening for allowing the selective communication between the interior of the chamber and the outside of the device, and the device further includes closure means for selectively closing or opening the at least one opening in the chamber, the opening of the chamber resulting from the actuation means causing the closure means to move from their closed condition to their open condition at the predetermined temperature.

In a second practical form of the delivery device of the invention the chamber is selectively openable or closable by virtue of relative movement of respective parts of the means defining the chamber under control of the temperature sensitive actuation means.

The delivery device of the present invention relies on a characteristic temperature change, typically a significant rise in temperature, indicative of the beginning of the stage in the wash cycle for which delivery of the washing material is required. This may typically be the beginning of a main wash stage in the cycle which is characterised by a higher water temperature than a cooler prewash stage. For example, a typical prewash stage in an automatic dishwasher may employ a relatively low water temperature of up to about 30, 35 or 40° C., e.g. a temperature in the range 15 to 30 or 35° C., whereas the following main wash stage may typically be at a significantly higher temperature, e.g. in the range 35 or 40 to 80° C., more often in the range 40 or 45 to 70° C. Such higher temperatures of the main wash stage are designed to optimise the performance of detergent compositions used in modern washing regimes. However, in the context of the invention the predetermined temperature or temperature range at which triggering of the washing material release mechanism is designed may be selected according to the detergent composition or other washing material with which the device is designed to be used.

The delivery device of the invention may be designed in particular for use with tablets of washing material, especially detergent compositions. Other physical forms of washing material may be possible however, e.g. powder, gel or possibly even liquid (in certain embodiments). The invention is not limited to the delivery of detergent compositions, although these are preferred, and any washing material or combination of washing materials, e.g. water softeners, rinse aids, bleaching compositions, may be used either singly or in combination, or possibly even in combination(s) with detergents, with the device of the invention.

In preferred embodiments of the first practical form of the dispensing device of the invention the chamber for housing the dose of washing material until it is delivered to the interior of the machine is formed by a housing having at least one aperture, preferably a plurality of apertures, formed in the walls of a lower region of the housing, in order to facilitate delivery of the material to the machine interior. When the aperture(s) are open to permit communication between the chamber within the housing and the interior of the machine, in which the delivery device is mounted for use, water or wash liquor within the machine is able to freely dissolve or disperse the washing material contained in the chamber, which action may be further improved by selecting particular sizes, shapes and distributions of apertures formed in the housing walls.

The closure means which close the apertures in the housing to shield the dose of washing material from water in the interior of the machine until release of the dose is triggered, may take various physical forms, e.g. slidable cover means, hinged or pivotal flaps or any other suitable mechanical means which can be readily moved from their closed to their open position by the temperature sensitive actuation means.

In a particularly preferred embodiment of this first form of device according to the invention, the device is formed as a two part housing, a lower, main housing part defining the chamber within which the dose of washing material is contained and from which it is released via one or more apertures in the lower region of that main housing part, and an upper, covering housing part being cooperable with, preferably telescopically slidable with respect to, the lower housing part. The upper covering housing part includes respective side wall portion(s) which close or open the aperture(s) in the lower housing part as the two housing parts are moved telescopically with respect to one another. The relative telescopic movement of the two housing parts is actuated by the temperature sensitive actuation means, such that the aperture(s) in the lower housing part is/are opened at the time the predetermined temperature is reached, as sensed by the actuation means. Further preferred constructional details of the closure means of this preferred embodiment of this first form of device according to the invention are described in detail later.

The temperature sensitive actuation means which trigger opening of the closure means when the predetermined temperature of the interior of the washing apparatus has been reached, signifying the reaching of the point or stage in the wash cycle when delivery of the washing material is required, may take various forms, although preferred are simple mechanical actuation means, examples of which may be already known in other technical fields where mechanical movement actuable upon dependence of temperature is required.

One preferred form of temperature sensitive actuation means in the context of this first form of device according to the invention comprises, in combination, an actuation element whose shape is dependent upon and varies with temperature, and biassing means which move the closure means from their closed to their open condition when triggered to do so by the temperature sensitive actuation element.

The temperature sensitive actuation element may for example be a bimetallic strip, as are well known per se and widely used in various types of thermostat. One end of the strip will typically be mounted fast on one of the two housing parts of the device, whilst the opposite, remote end of the bimetallic strip is provided with catch means which cooperate with detent means provided on the other of the housing parts. When the bimetallic strip is in its cool state the catch and detent means cooperate to lock the two housing parts together so that relative movement of the two housing parts from their closed to their open condition is prevented, whereas when the bimetallic strip is in its hot state (when it is subjected to the triggering temperature) its shape is deformed such that the catch and detent means are released from one another, thereby allowing the two housing parts to move freely with respect to one another to open the apertures to permit delivery of the washing material from within the housing chamber.

The biassing means which cause this displacement of the two housing parts when the catch and detent means are released is preferably some type of spring means. In certain embodiments it may be a simple tension or compression spring mounted with each of its ends fast with one of the respective housing parts, so that the spring force urges the housing parts to move apart. Alternatively, one or more, preferably a pair of, leaf spring members may be employed, each of which has one end fixed in relation to one part of the housing, with the opposite end abutting a respective abutment seating portion on the other of the housing parts. The spring force of the leaf spring members act together to move the housing parts apart with respect to one another in the desired manner.

For mechanical simplicity, such leaf spring members do not necessarily need to exert high spring forces, in which case they may be provided as integral leaf spring member extensions from the main body of the housing part with which they are formed integrally by moulding.

A second preferred form of temperature sensitive actuation means in the context of this first form of device according to the invention comprises simply a bimetallic strip (or other actuation element whose shape is dependent upon and varies with temperature) on its own, without an associated biassing means. Preferably the bimetallic strip is anchored at one end to one of the two housing parts of the device, and the other, remote, end of the bimetallic strip is able to move from a locked position to an unlocked position when the predetermined triggering temperature (or temperature range) is reached. The remote end of the bimetallic strip is preferably formed into a catch element which, when that end of the bimetallic strip is in its locked position, engages with a detent element on the other of the two housing parts to lock the two housing parts together in their closed condition in which the chamber containing the dose of washing material is closed. When the triggering temperature is reached, the bimetallic strip deforms, whereby its remote end having the catch means is displaced into its unlocked position in which it ceases to retain the detent element on the other of the two housing parts, thereby enabling the two housing parts to slide apart, preferably simply under the influence of gravity on the lower of the two housing parts, so as to open the chamber to expose the dose of washing material contained therein. Limiting stop means are preferably incorporated into the device to limit the relative sliding displacement of the two housing parts. This particular form of temperature sensitive actuation means is particularly useful in that it employs only a single component, making for simpler and cheaper construction of the overall device.

As an alternative to this bimetallic strip used on its own in this alternative form of temperature sensitive actuation means in the context of the first form of device according to the invention, it is possible to use any other suitable form of temperature sensitive element which causes the respective housing parts to move apart or together to open or close the chamber in dependence on the temperature. One form of such an alternative actuation means is a memory spring such as in the form of a coil spring formed of memory material which is designed to adopt either an expanded or a contracted configuration at selected different temperatures. Such memory springs, e.g. of bimetal material, are known in the art and are for example known for use in actuating cut-off valves in central heating systems. An advantage of a memory spring over the other forms of actuation means defined above is that it acts as a truly reversible opening/closing mechanism for the respective housing parts.

This principle of a memory spring can be advantageously extended to an actuation means for use in the context of the second practical form of delivery device according to the invention. In this second form of device, the housing preferably comprises left side and right side housing parts which define therebetween the chamber for containing the dose of washing material and are connected together by means of a hinge connection in an upper region. Thus, as the left and right side housing parts are hinged apart relative to one another, their lower parts defining the chamber for the dose of washing material move apart so as to open the chamber to allow communication between the interior of the chamber and the outside of the device. This hinging relative movement of the two housing parts is actuated and controlled by a memory spring mounted on the device with each of its ends anchored on a respective one of the left and right side housing parts.

For simplicity and cheapness of manufacture, the complete housing of the various forms of delivery device of the invention may be readily formed by an injection moulding or other suitable moulding technique, e.g. from a plastics material, e.g. polypropylene.

In practical embodiments of the various forms of delivery device of the invention the housing preferably includes one or more loading openings in its upper region, via which the dose of washing material can be loaded into the device prior to the beginning of the wash cycle. Such loading opening(s) are closeable and sealable to an extent sufficient to prevent ingress of water during the prewash stage of the wash cycle, by means of any suitable form of closure flap, trap door or the like, which in preferred embodiments may include means for and ensuring against unintentional opening such as resulting from vibration or contact from food debris, e.g. by means of a snap fit arrangement.

The various forms of delivery device of the invention preferably include means for attachment to part of the interior of the washing apparatus, particularly the plate tray or cutlery basket of a dishwashing machine. For this purpose the device preferably further includes hook or clip means to enable it to be simply clipped onto the desired mounting part in the interior of the machine prior to the wash cycle commencing. If desired, the device may be unclipped after each wash cycle and reloaded with the necessary dose of washing material externally of the machine prior to it being replaced therein in readiness for the beginning of the next wash cycle. Generally, however, the device may conveniently remain mounted in the interior of the machine and each new dose of washing material loaded into it whilst the device remains in situ.

Further preferred and/or optional features of the various forms of delivery device of the invention will be apparent from the detailed description of preferred embodiments thereof which now follows, with reference to the accompanying drawings, in which:

BRIEF DESCRIPTION OF THE DRAWINGS

FIG. 4(*d*) is a schematic side cross-sectional view of the device as shown in FIG. 4(*a*) with the two housing parts in their open condition;

DETAILED DESCRIPTION OF PREFERRED EMBODIMENTS

Figure 1:
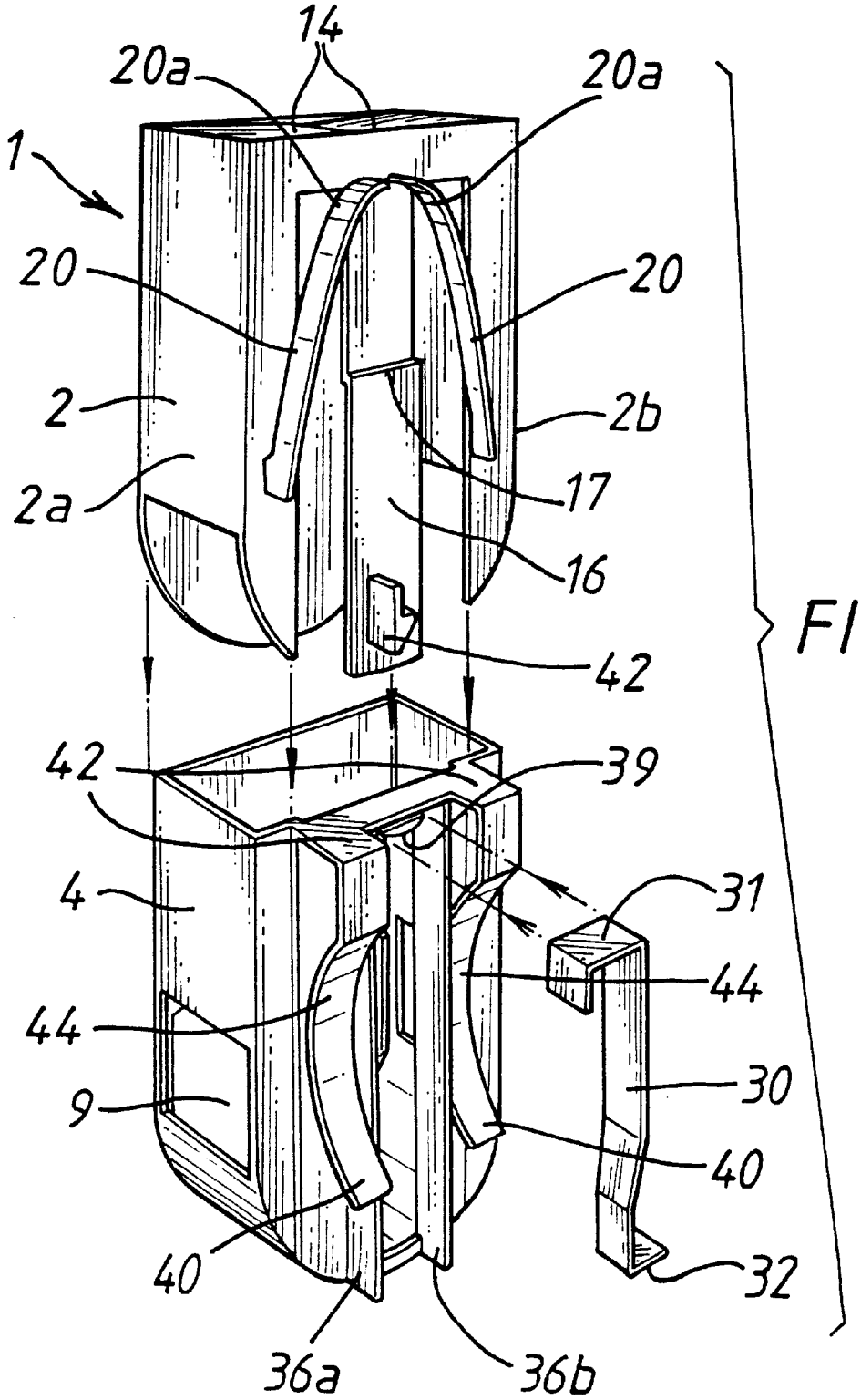
FIG. 1 is an exploded rear perspective view of a delivery device according to a first preferred embodiment of the invention.

Referring firstly to FIG. 1, the delivery device indicated generally as 1 according to a first preferred embodiment of the invention comprises a housing consisting of lower housing part 4 and upper housing part 2. The lower housing part 4 defines therewithin a chamber for containing a dose of washing material, e.g. a detergent tablet, ready for delivery into the interior of a dishwashing machine into which the device is to be mounted for use. The upper and lower housing parts 2, 4 are constructed such that the two housing parts can be brought together in a sliding telescoping fashion, with the side walls of upper housing part 2 lying externally of the corresponding side walls of lower housing part 4.

Formed in the side walls of the lowermost region of the lower housing part 4 are a pair of windows or apertures 9 (only the aperture 9 on one side of the housing is shown in FIG. 1), it being via these apertures 9 that communication is provided between the chamber within the lower housing part 4 and the outside, i.e. the interior of the dishwasher when the device is in use, so that water or wash liquor can freely enter the chamber via the apertures to flush out the washing material therefrom. One or more further apertures are preferably formed in the lower region of the front wall of the lower housing part 4, although these are not visible in the drawing.

The side walls 2*a* and 2*b* (and, if appropriate, the front wall (not shown)) of upper housing part 2 constitute the closure means which obscure and thereby close the respective apertures 9 in the walls of the lower housing part 4 as the two housing parts 2, 4 are slid telescopically together. The upper housing part 2 is provided with a tongue element 16 which acts as a guide for the relative telescopic sliding motion of the two housing parts as they move between their open and closed conditions. The tongue element 16 slides within a channel formed in approximately the upper half region of the rear wall of the lower housing part 4 and bounded by spaced apart ribs 36*a*, 36*b*. The upper and lower limits of the thus formed channel serve to define upper and lower limit stops on the relative telescopic movement of the two housing parts 2, 4, in combination with a step 17 formed midway along the tongue element 16.

Figure 2:
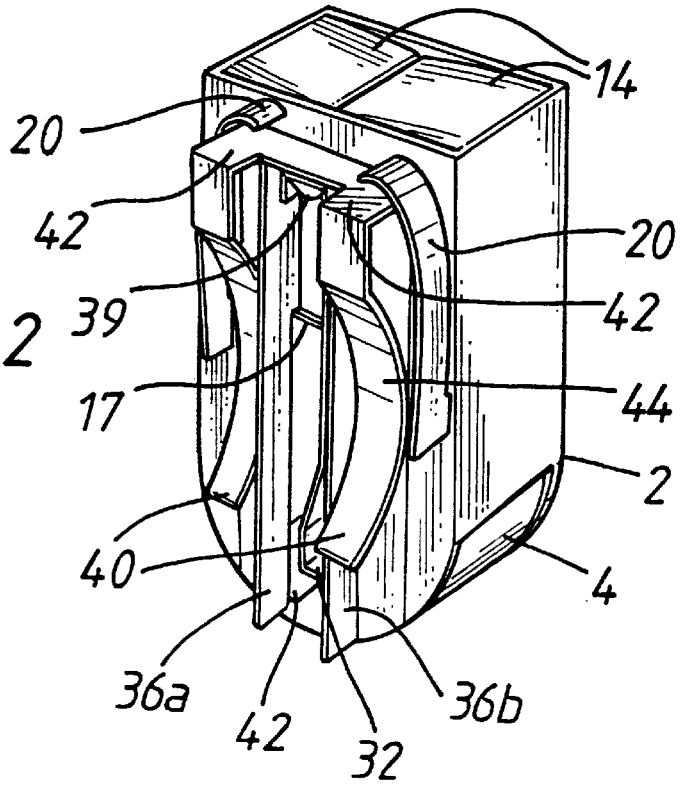
FIG. 2 is a rear perspective view (from a different perspective from that of FIG. 1) of the device of FIG. 1 showing the two housing parts in their closed condition.
Figure 3:
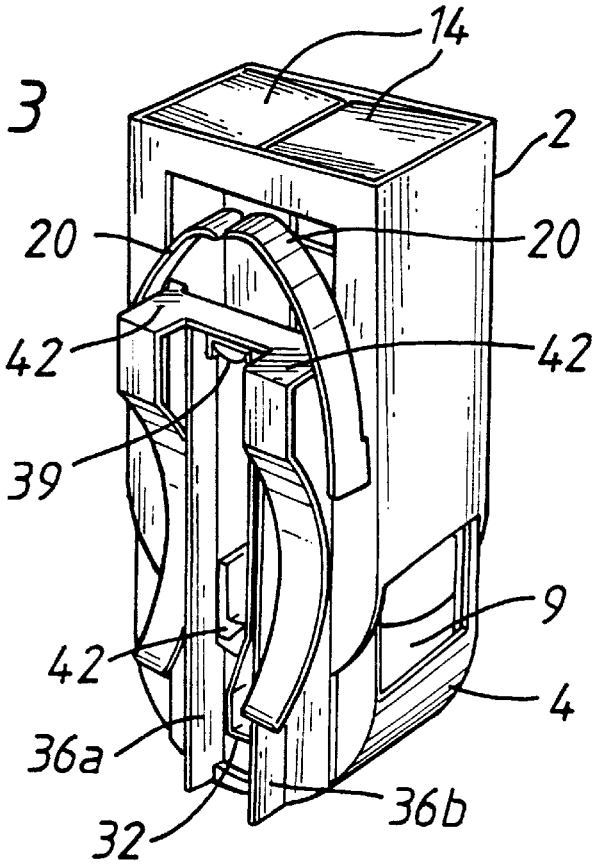
FIG. 3 is a rear perspective view of the same device of FIG. 2 showing the two housing parts in their open condition.
Figure 4A:
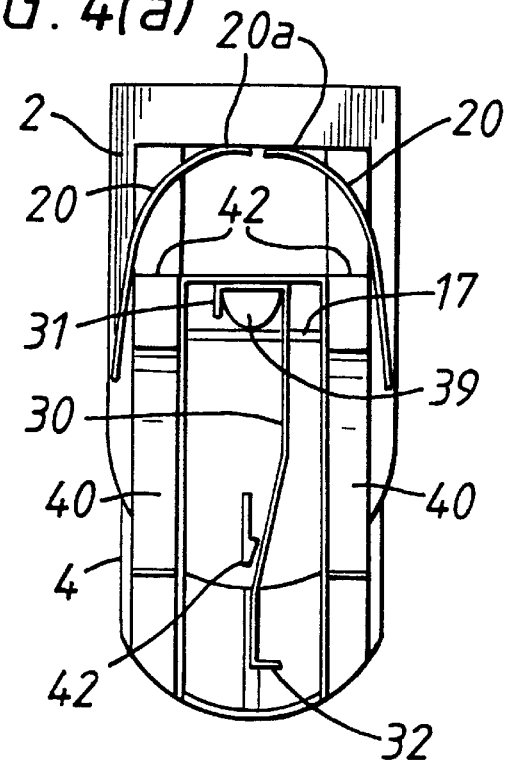
FIGS. 4(*a*), 4(*b*) and 4(*c*) are schematic part-cutaway rear views of the device of FIG. 1 showing the configuration of the various parts of the device with the two housing parts in, respectively, their open, closed, and partially open conditions.
Figure 4B:
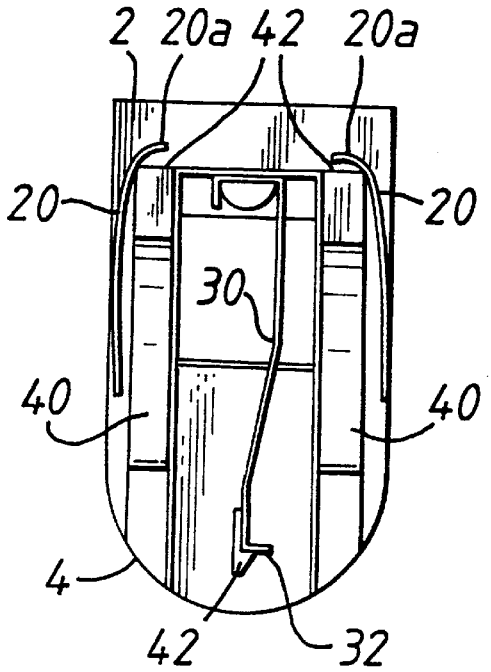
Figure 4C:
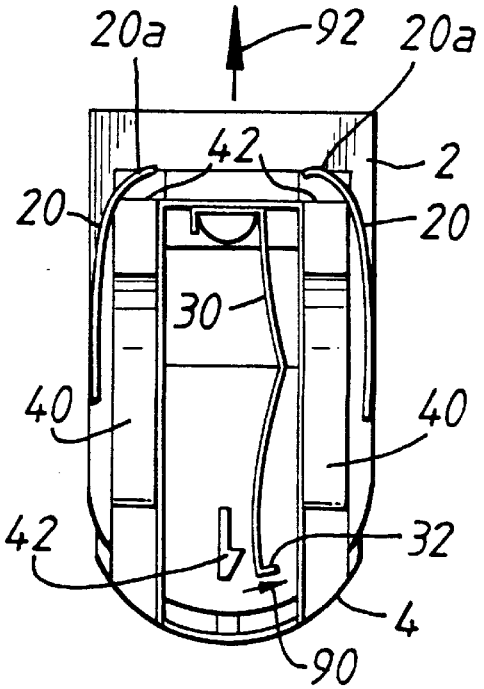
Figure 4D:
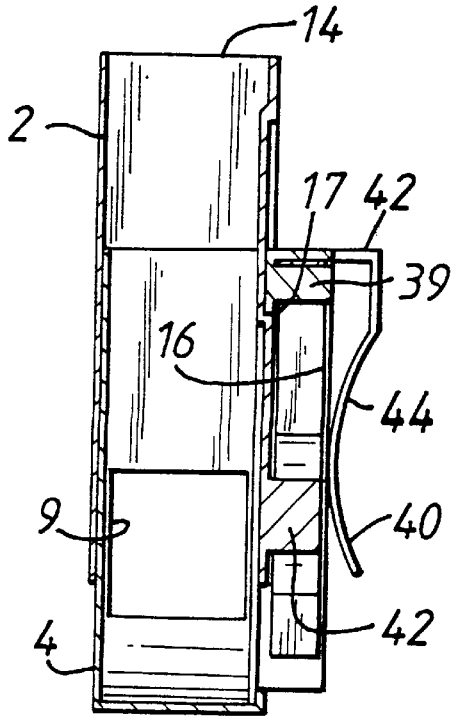

As seen more clearly in FIGS. 2 and 3, the top wall of the upper housing part 2 is formed with a pair of trap door flaps 14, each of which is moulded integrally with the respective side walls 2*a*, 2*b* of the upper housing part 2. Again, the resilience of the material from which the moulding is made enables the flaps 14 to be sufficiently resiliently hingeable about their lines of connection to each respective side wall to enable a detergent tablet to be inserted into the device simply by pushing it through the gap and past the trap door flaps 14 as they flex downwards under manual insertion pressure. Once through and the detergent tablet is safely disposed within the device, the trap door flaps 14 spring back into their closed condition as seen in FIG. 2, in which condition they sufficiently close and seal the interior of the device from water or wash liquor within the machine interior when the device is in use. Given that in the majority of automatic dishwashing machines water is delivered from spray means coming from beneath the plate tray or cutlery basket, it is generally not necessary for the sealing action of the trap door flaps 14 to be particularly great and in practical applications it is unlikely to matter very much if there is any small leakage of water into the device via the upper trap door flaps 14.

Extending rearwardly from the rear wall of the lower housing part 4 are a pair of clip elements 40 which enable the device to be clipped onto a plate tray or cutlery rack of the dishwasher and held securely in place during use. The central portions 44 of the clip elements 40 can be shaped appropriately to provide optimum securement at the site for which mounting of the device is particularly intended. The clip elements 40 are attached integrally to the rear wall of the lower housing part 4 by respective bridging portions 42 which also provide respective abutment portions against which act leaf spring members 20 which cause the two housing parts to slide apart from one another in a telescopic manner when triggered to do so by release of the temperature sensitive actuation means, which will be described in detail further below.

Each leaf spring member 20 is formed integrally at its lower end with the upper housing part 2 and the free upper end portions 20*a* of the leaf spring members 20 are curved towards each other. The resilience of the leaf spring members 20 and the moulded curved shape of their upper portions 20*a* provide the necessary biassing force to urge the housing parts 24 apart when they are freed to do so.

Forming the other principal essential component of the temperature sensitive actuation means is bimetallic strip 30, which is mounted between the ribs 36*a*, 36*b* at the rear of the lower housing part 4. The upper end 31 of the bimetallic strip 30 is mounted fast on the lower housing part 4 by means of clamping element 39. The bimetallic strip 30 may be of a conventional type and construction, and suitable examples will be well known and readily available to the person skilled in the art.

Essentially the bimetallic strip comprises a fused pair of strips of different metals which have significantly different coefficients of heat expansion. The strip 30 is constructed such that at ambient temperature it assumes a shape substantially as that shown in FIG. 4(*a*), but at an elevated temperature, e.g. a temperature in the range 35 or 40 to 60° C., the strip deforms so as to bend in the direction shown by arrow 90 in FIG. 4(*c*). Given the aqueous environment in which the bimetallic strip mounted on the device will generally be used, the material(s) of the bimetallic strip may be selected if desired so as to eliminate or minimise corrosion, or alternatively the entire strip may be coated in a protective layer or sheath, e.g. of plastics material.

The lower end of the bimetallic strip 30 is formed into a foot 32 which constitutes a catch means which cooperates with a projecting detent element 42 moulded with and extending outwardly from the lower end of tongue element 16 of the upper housing part 2. Catch element 32 and detent element 42 engage one another when the upper and lower housing parts 2, 4 are in their closed condition, as shown in FIG. 4(*b*), in which condition the upper curved portions 20*a* of the leaf spring members 20 are stressed and are resiliently biassed to abut against the abutment portions 42 of the lower housing part 4. Thus, with the upper and lower housing parts 2, 4 in their closed condition as shown in FIG. 4(*b*) the device is securely shut, held so by the catch and detent elements 32, 42, and with the device in this configuration the detergent tablet contained therewithin is shielded from the interior of the washing apparatus until such time as opening of the device is triggered.

That triggering is signalled by what may typically be a relatively sharp increase in temperature in the interior of the machine, heralded by the end of a prewash stage of the washing cycle and the commencement of the main wash stage for which delivery of the washing material is required. The increase in temperature causes the bimetallic strip 30 to deform in the direction shown by arrow 90 in FIG. 4(*c*), thereby releasing catch element 32 from detent element 42. The resilient force exerted by the leaf spring members 20 on the abutment portions 42 of the lower housing part 4 then causes the upper housing part 2 to slide telescopically in an upward direction relative to the lower housing part 4, as shown by arrow 92 in FIG. 4(*c*), and in this way the two housing parts 2, 4 start to slide apart from one another. This relative sliding apart movement continues until the side walls 2*a*, 2*b* of the upper housing part 2 are retracted from the apertures 9 in the walls of the lower housing part 4, thereby opening them to allow communication between the interior chamber within the device and the interior of the machine. The two housing parts by this time assume their open condition, as shown in FIG. 3.

The relative sliding apart movement of the two housing parts is limited by the step feature 17 formed in the tongue element 16, as described earlier, so that effectively the maximum telescopic sliding apart movement of the two housing parts is into that condition as illustrated in FIG. 3. Water or wash liquor within the washing apparatus can therefore now freely enter the interior chamber within the device to dissolve or disperse the washing material contained therewithin and flush it out through the apertures 9, with the result that the material is able to be efficiently delivered into the interior of the machine.

FIG. 4(*a*) shows the two housing parts 2, 4 of the device in their open position either before the wash cycle commences or once it has finished and the temperature inside the machine has returned to ambient, the bimetallic strip 30 having returned to its normal undeformed state. With the device in this open condition prior to commencement of the wash cycle, in order to load the device with the desired dose of washing material, e.g. tablet of detergent composition (in this context "tablet" is to be interpreted as meaning simply a block which may typically be in the form of a flat cylinder approximately 1 cm to 2 cm in thickness and 2 cm to 5 cm in diameter), the upper and lower housing parts 2, 4 are slid together so as to reach their closed condition as shown in the FIG. 4(*b*). This sliding action causes detent element 42 to be pushed past the catch element 32 at the foot of the bimetallic strip 30 so that the catch element 32 engages the detent step provides on the detent element 42, as illustrated. The detergent tablet can then be inserted into the device past the trap door flaps formed in the top wall of the upper housing part 2, as already described. In practice, it may be possible for the detergent tablet to be inserted into the device prior to the two housing parts being closed together.

Turning now to FIGS. 5 to 8 of the drawings, here there is shown a second embodiment of the delivery device of the invention. This embodiment corresponds very closely in construction and operation to the embodiment shown in FIGS. 1 to 4, except here the principal difference lies in the nature of the biassing means which urges the upper and lower housing parts 102, 104 from their closed into their open condition.

Figure 5:
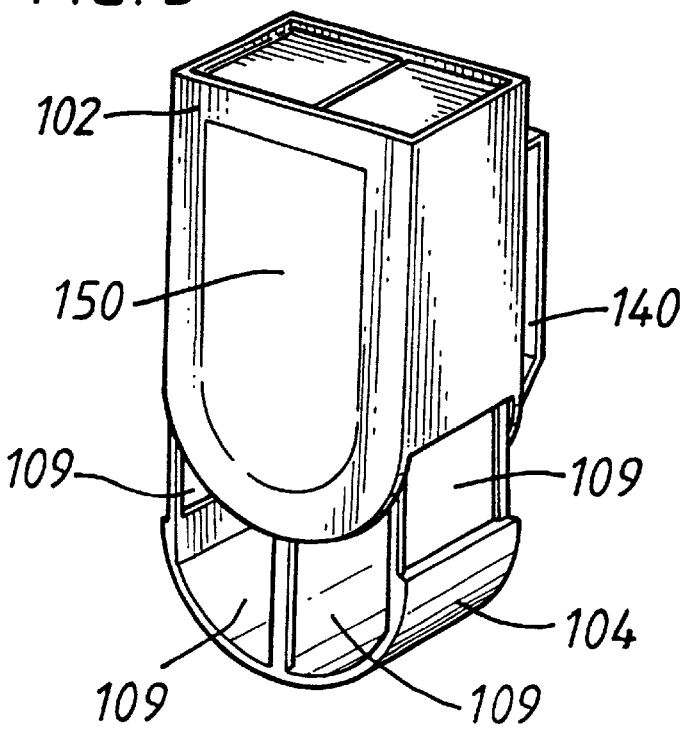
FIG. 5 is a front perspective view of a delivery device according to a second preferred embodiment of the invention, showing the two housing parts in their open condition.

FIG. 5 shows the device of this second embodiment from the front side, with the upper and lower housing parts 102, 104 in their open condition. In this embodiment, a plurality of apertures 109 are provided in the lower region of the lower housing part 104, so that access to the interior chamber within the device is possible from virtually any direction. The front surface 150 of the upper housing part 102 may conveniently provide a land for the placement of a label, trade mark material, indicia or any other desired decorative features.

Figure 6:
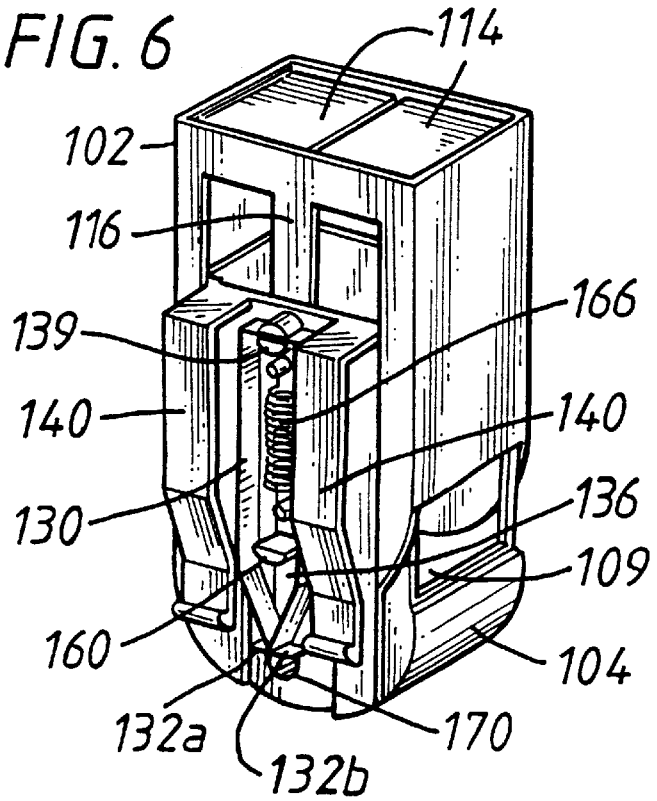
FIG. 6 is a rear perspective view of the device shown in FIG. 5, again with the two housing parts in their open condition.

FIG. 6 shows the same device in its open condition as in FIG. 5, but here from the rear. The biassing means in this embodiment comprises a tension spring 166 which is anchored at its uppermost end adjacent the clamping element 139 on which is mounted bimetallic strip 130. In this embodiment the bimetallic strip 130 consists of a double strip anchored at its centre by clamp 139. Portions of the bimetallic strip extend generally parallel to one another from the clamp 139 and each leg of the strip 130 terminates in an outwardly projecting foot 132*a*, 132*b*, each of which acts as a catch element in generally the same manner as does the single catch element 32 of bimetallic strip 30 of the first embodiment of the invention illustrated in FIGS. 1 to 4. However, in this embodiment the detent element provided on the upper housing part 102 takes the form of a flat-topped peg 160 which is mounted on the lower end of tongue element 116 and projects through and moves along a slot 136 formed in the rear wall of the lower housing part 104 in an analogous manner as detent element 42 within the channel formed between ribs 36*a*, 36*b* in the first embodiment of the invention as shown in FIG. 1. The lower end of the spring 166 is attached and moves with the peg 160 mounted on the tongue element 116, so that the tension force provided by the spring 166 provides the force which urges the upper and lower housing parts 102, 104 apart when triggered to do so by release of the catch and detent elements 132*a*, 132*b*, 160 in an exactly analogous manner to the actuation of the corresponding actuation means in the context of the first illustrated embodiment of the invention.

Figure 7:
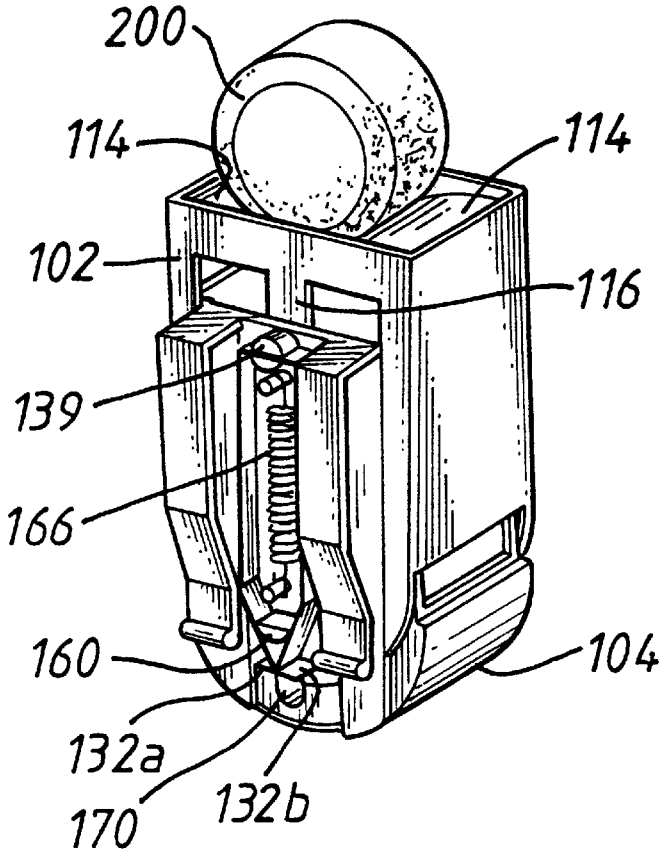
FIG. 7 is a rear perspective view of the device shown in FIG. 6, showing a detergent tablet in the process of being inserted into the device and with the two housing parts in the process of being brought from their open into their closed condition.
Figure 8:
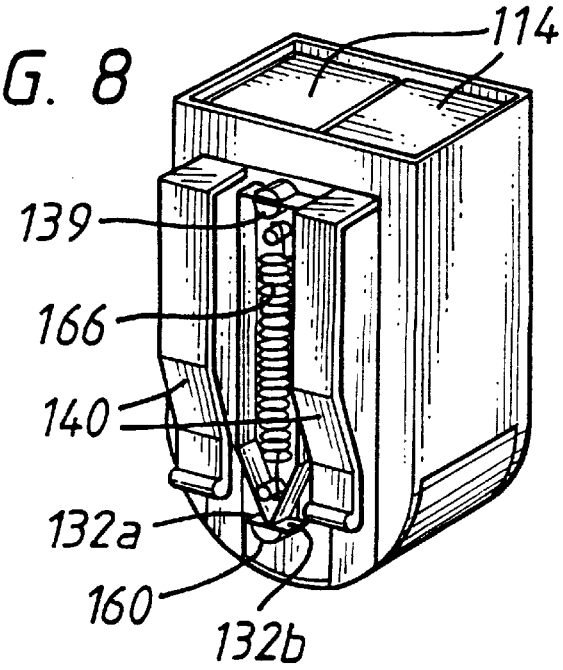
FIG. 8 is a rear perspective view of the device shown in FIG. 6, but with the two housing parts in their closed condition.

The device in the condition shown in FIG. 7 corresponds to that of the device shown in FIG. 4(*a*), but further shows a detergent tablet 200 in the process of being inserted into the device through and past the upper trap door flaps 114, as already described. FIG. 8 shows the device in its closed condition ready for mounting in the interior of the dishwashing machine, and corresponds to the condition of the device of the first embodiment illustrated in FIG. 4(*b*).

Figure 9:
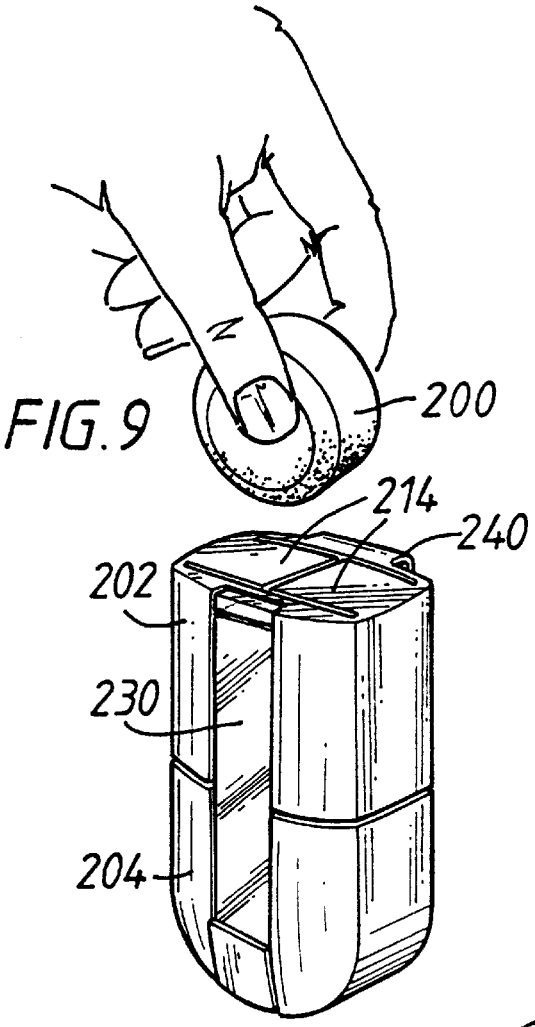
FIG. 9 is a front perspective view of a delivery device according to a third preferred embodiment of the invention, showing the two housing parts in their closed condition.
Figure 10:
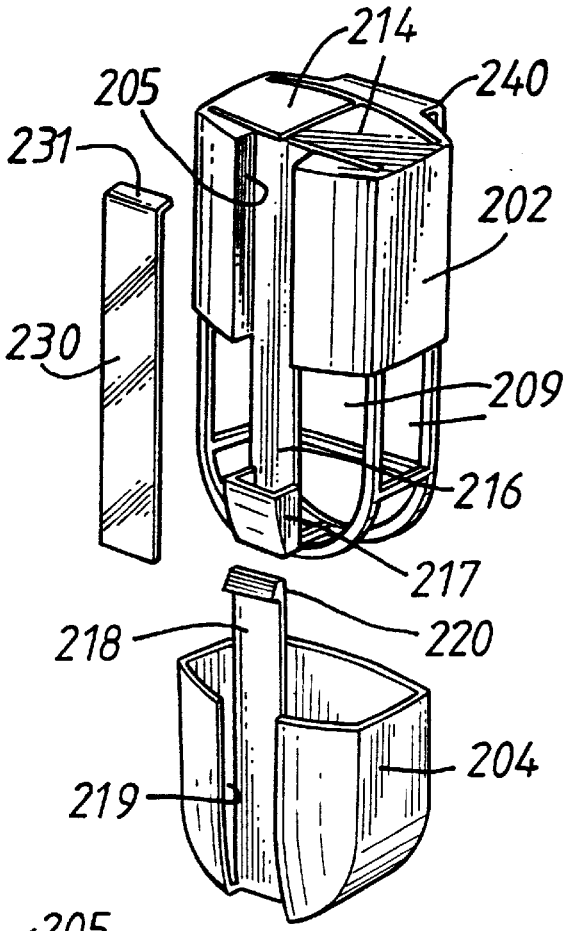
FIG. 10 is an exploded perspective view showing the component parts of the device of FIG. 9.
Figure 11:
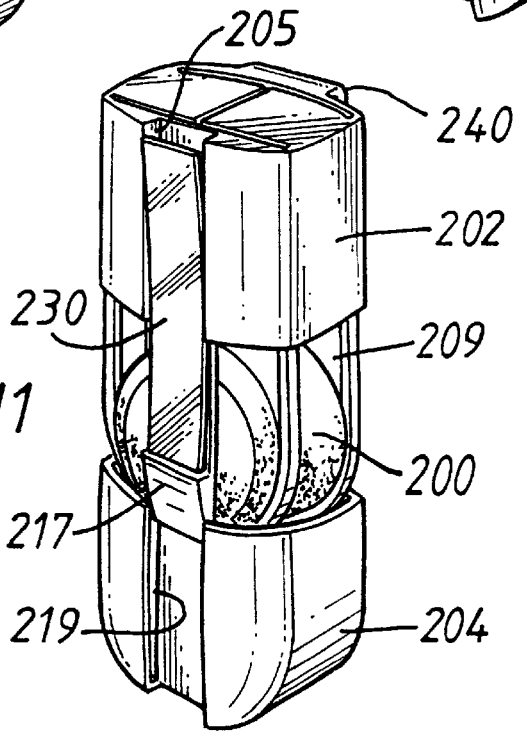
FIG. 11 is a front perspective view of the device of FIG. 9, but showing the two housing parts in their open condition.

Turning now to FIGS. 9 to 11 of the drawings, here there is shown a third embodiment of the delivery device of the invention, the basic structure of which in terms of the telescopically slidable upper and lower housing parts 202, 204 corresponds very closely to that of the first and second embodiment devices described above.

FIG. 9 shows the device of this third embodiment with the upper and lower housing parts 202, 204 in their closed condition. The upper housing part 202 is provided with similar trap door flaps 214 for allowing insertion into the chamber within the device of detergent tablet 200. Similar clip means 240 are provided on the rear of the device to enable it to be clipped onto an appropriate mounting location within the interior of the dishwashing apparatus.

As shown in FIG. 10, the upper housing part 202 is formed with its lower section defining a cage having a plurality of apertures 209 for allowing water or wash liquor to contact and dissolve the detergent tablet when the chamber is opened (which condition is illustrated in FIG. 11). Extending downwardly from the upper section of the upper housing part 202 and alongside the cage is a tongue element 216 having at its foot a channel element 217 within which is slidably accommodated arm member 218 extending upwardly from the base of lower housing part 204. Arm member 218 slides within the channel element 217 as the housing parts move apart or together.

Constituting the temperature sensitive actuation means is bimetallic strip 230 which is anchored at its lower end in the channel element 217 at the foot of the tongue element 216. In its cold configuration the bimetallic strip 230 is substantially flat and lies within a channel 205 formed in the upper section of the upper housing part 202. The upper end of the bimetallic strip 230 is formed into a catch element 231 which cooperates with detent element 220 formed at the upper end of arm member 218 extending from the lower housing part 204. Thus, with the parts of the device assembled, as the upper and lower housing parts 202, 204 are slid together into their closed condition, the detent element 220 rises above and catches on the catch element 231 of the bimetallic strip 230, thereby locking the two housing parts 202, 204 in their closed condition, as shown in FIG. 9.

When the predetermined temperature or temperature range is reached at which the device is required to open, the bimetallic strip deforms such as to displace its upper end outwardly from the channel 205, thereby releasing the catch element 231 from the detent element 220 and allowing the lower housing part 204 to move apart from the upper housing part 202 under gravity. As the two housing parts slide apart, the channel element 217 slides upwards through channel 219 formed in the lower housing part 204, whilst arm member 218 slides downwardly through channel 205 formed in the upper section of the upper housing part 202. The open condition reached by the two housing parts is illustrated in FIG. 11, in which there is also shown the detergent tablet 200 in the cage of the upper housing part 202 exposed for dissolution by the water or wash liquor within the washing apparatus.

When the wash cycle is complete and it is desired to reset the delivery device for the next wash, the two housing parts are simply slid back together and the catch and detent elements 231, 220 clicked back into position, whereby the two housing parts are locked together so as to readopt the closed condition as shown in FIG. 9.

The detent element 220 and channel element 217 incorporate a limit stop (not shown in the drawings) in order to limit the downward movement of the lower housing part 204 relative to the upper housing part 202, in order to define a maximum open condition of the device.

Figure 12:
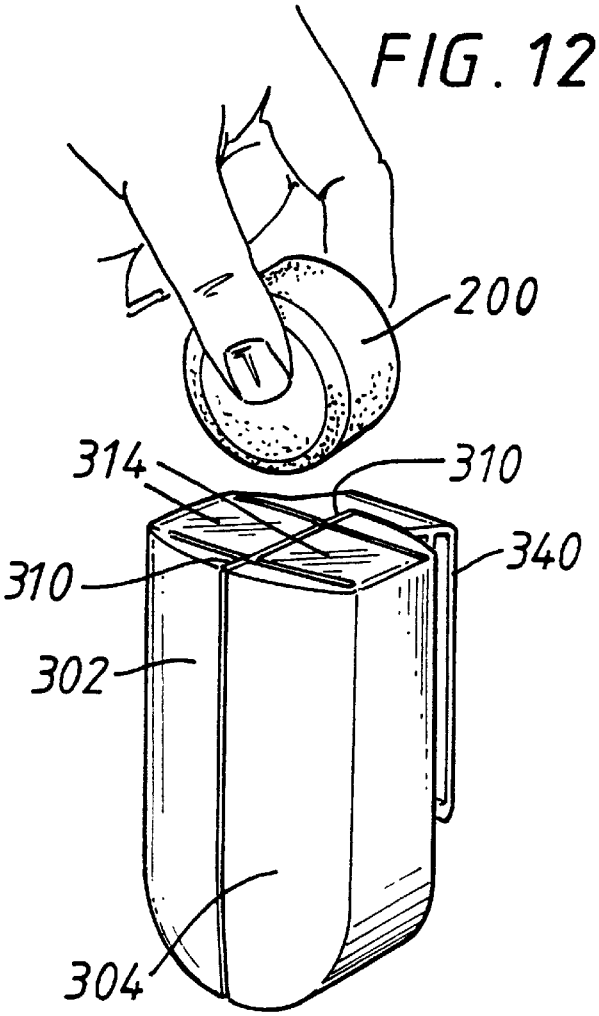
FIG. 12 is a front perspective view of a delivery device according to a fourth preferred embodiment of the invention, showing the two housing parts in their closed condition.
Figure 13:
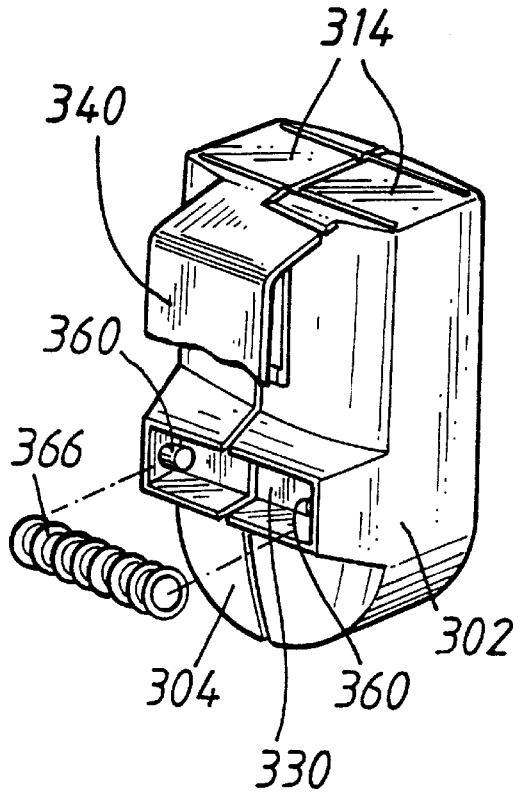
FIG. 13 is an exploded rear perspective view of the device of FIG. 12, showing its component parts.
Figure 14:
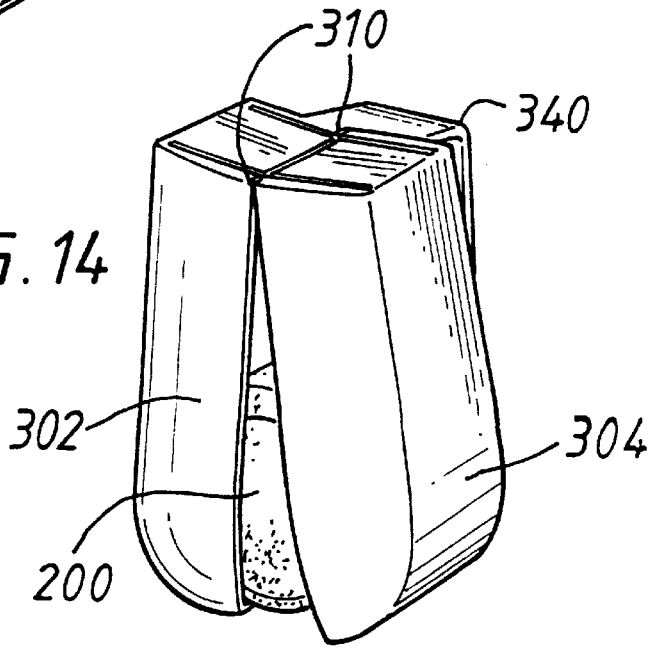
FIG. 14 is a front perspective view of the device of FIG. 12, showing the two housing parts in their open condition.

Turning now to FIGS. 12 to 14 of the drawings, here there is shown a fourth embodiment of the delivery device of the invention. This form of the device is particularly advantageous in that it incorporates fewer components and is therefore potentially easier and cheaper to manufacture.

In this form of the device the two housing parts differ from those of the previously described embodiments in that they are not telescopically slidable with respect to one another in order to define their open and closed conditions, but instead are left side and right side housing parts which are hingedly connected in their upper region. The left side and right side housing parts 302, 304 define between them the chamber for accommodating a detergent tablet 200 and again the two housing parts together are provided with trap door flaps 314 for permitting insertion of a detergent tablet 200 into the device prior to use. Also again, clip means 340 (shown partly cut away for clarity in FIG. 13) are provided on the rear of the device to enable it to be mounted inside the washing apparatus at an appropriate location.

The housing parts 302, 304 are hingedly connected such as at locations 310 by any suitable hinge mechanism. In preferred embodiments where the housing parts are formed from moulded plastics material, these hinges 310 may conveniently be formed by bridges of reduced thickness material formed in a process where the complete device is made by integral moulding.

The opening and closing of the housing parts 302, 304 is actuated and controlled by a memory spring 366. Such springs formed from memory metal material are available for example from Memory Metals Limited of Ipswich, Suffolk, England. By way of example, a suitable memory spring for use in this embodiment of the invention is designed to commence the expansion from its first, contracted condition into its second, expanded condition in a temperature range of from about 35° C. to about 44° C. Each of the housing parts 302, 304 has formed on its rear one half of a channel section 330 which has closed ends. The channel itself may be open or closed to the rear. Mounted within each end of the channel section 330 is a securing lug 360, the opposite ends of the memory spring 366 being anchored to the respective securing lugs 360.

Thus, depending upon the contracted or expanded condition of the memory spring 366, the left side and right side housing parts 302, 304 will be either pulled together into their closed condition (as shown in FIG. 12) or pushed apart into their open condition (as shown in FIG. 14).

The extent of the opening apart of the housing parts 302, 304 may be controlled by the length of the memory spring 366 and/or the distance by which the spring expands/contracts within the range of temperatures for which it is designed to be used. For instance, and as illustrated in FIG. 14, the housing parts may be designed to open just sufficiently to enable adequate access to the interior chamber by water or wash liquor in the washing apparatus to enable the detergent tablet 200 to be dissolved, whilst not opening far enough to allow the detergent tablet to completely drop out of the device under gravity, at least during the initial stages of its dissolution. This provides for optimum dissolution characteristics and thus optimum efficacy of the detergent tablet in the wash cycle.

It is to be understood that the present invention has been described above by way of example only with reference to various non-limiting presently preferred embodiments. Various modifications may be made from that which has been specifically described and illustrated whilst still falling within the scope of the invention as defined in the appended claims, as will be readily apparent to persons skilled in the art.

What is claimed is:

1. A delivery device for delivering a dose of washing material into the interior of a washing apparatus, the device comprising:

a chamber for containing the dose of washing material to be delivered, the chamber being selectively openable or closable for selectively allowing communication between the interior of the chamber and the outside of the device; and temperature sensitive actuation means constructed and arranged for causing the chamber to be opened from a closed condition at a point or stage in the wash cycle of the apparatus at which a predetermined temperature within the interior of the apparatus is reached, wherein the chamber includes at least one opening for allowing the selective communication between the interior of the chamber and the outside of the device, and the device further includes closure means for selectively closing or opening the at least one opening in the chamber, the opening of the chamber resulting from the actuation means causing the closure means to move from their closed condition to their open condition at the predetermined temperature and wherein the housing is a two part housing, the housing having a lower housing part defining the chamber within which the dose of washing material is contained and from which it is released via apertures in a lower region of the lower housing part, and an upper housing part which is cooperable with the lower housing part, the closure means for the apertures being provided by respective wall portions of the upper housing part, which wall portions close or open the apertures in the lower housing part as the two housing parts move between their relative closed and opened positions.

2. A delivery device according to claim 1, wherein the temperature sensitive actuation means triggers opening of the closure means when a temperature within the interior of the apparatus in the range 35 to 80° C. is reached.

3. A delivery device according to claim 1, wherein the upper and lower housing parts are cooperable in a telescopic manner, whereby the upper and lower housing parts are movable between their relative closed and open positions by means of a telescopic relative sliding motion.

4. A delivery device according to claim 1, wherein the temperature sensitive actuation means comprises an actuation element whose shape is dependent upon and varies with temperature.

5. A delivery device according to claim 4, wherein the temperature sensitive actuation means further comprises biassing means which move the closure means from their closed condition to their open condition when triggered to do so by the temperature sensitive element.

6. A delivery device according to claim 4, wherein the temperature sensitive actuation element is a bimetallic strip.

7. A delivery device according to claim 4, wherein the temperature sensitive actuation element is a memory spring.

8. A delivery device according to claim 1, further including at least one loading opening, via which at least one loading opening the dose of washing material is loadable into the chamber of the device prior to the beginning of the wash cycle of the apparatus.

9. A delivery device according to claim 1, further comprising means for attachment of the device to part of the interior of the washing apparatus.

10. A method of delivering a dose of washing material into the interior of a washing apparatus at a point or stage in a wash cycle thereof at which a predetermined temperature within the interior of the apparatus is reached, the method comprising:

providing a delivery device according to claim 1;

loading a dose of the washing material into the chamber of the delivery device;

either before or after the preceding loading step, placing the delivery device in the interior of the washing apparatus; and initiating the wash cycle of the apparatus;

whereby at the point or stage in the wash cycle at which the predetermined temperature within the interior of the apparatus is reached, the temperature sensitive actuation means causes the chamber to be opened from a closed condition, so as to allow communication between the interior of the chamber and the interior of the washing apparatus, and thereby enabling the dose of washing material to be delivered therefrom into the interior of the washing apparatus.

11. A method according to claim 10, wherein the dose of washing material is a detergent tablet.

12. A delivery device for delivering a dose of washing material into the interior of a washing apparatus, the device comprising:

a chamber for containing the dose of washing material to be delivered, the chamber being selectively openable or closable for selectively allowing communication between the interior of the chamber and the outside of the device; and a temperature sensitive memory spring whose shape is dependent upon and varies with temperature, said memory spring being constructed and arranged for causing the chamber to be opened from a closed condition at a point or stage in the wash cycle of the apparatus at which a predetermined temperature within the interior of the apparatus is reached.

13. A delivery device according to claim 12, wherein the chamber comprises a two part housing having a first part and a second part connected together by a hinge.

* * * * *